US007770508B2

(12) United States Patent
Ferraresi et al.

(10) Patent No.: US 7,770,508 B2
(45) Date of Patent: Aug. 10, 2010

(54) DOUBLE-ACTING DEFORMABLE FLUID ACTUATOR OF THE MUSCLE TYPE WITH THREE CHAMBERS

(75) Inventors: Carlo Ferraresi, Piossasco (IT); Walter Franco, Cueno (IT); Giuseppe Quaglia, Piscina (IT)

(73) Assignee: Politecnico di Torino, Turin (IT)

( * ) Notice: Subject to any disclaimer, the term of this patent is extended or adjusted under 35 U.S.C. 154(b) by 1007 days.

(21) Appl. No.: 10/592,027

(22) PCT Filed: Mar. 10, 2005

(86) PCT No.: PCT/IB2005/000595

§ 371 (c)(1),
(2), (4) Date: Sep. 7, 2006

(87) PCT Pub. No.: WO2005/088138

PCT Pub. Date: Sep. 22, 2005

(65) Prior Publication Data

US 2007/0186712 A1 Aug. 16, 2007

(30) Foreign Application Priority Data

Mar. 10, 2004 (IT) ..... TO2004A0150

(51) Int. Cl.
*F01B 19/00* (2006.01)
*F15B 15/10* (2006.01)

(52) U.S. Cl. ..... 92/50; 92/75; 92/90

(58) Field of Classification Search ..... 92/35, 92/37, 50, 64, 69 R, 75, 90
See application file for complete search history.

(56) References Cited

U.S. PATENT DOCUMENTS

| | | | | | |
|---|---|---|---|---|---|
| 2,844,126 | A | * | 7/1958 | Gaylord | 92/90 |
| 4,777,868 | A | * | 10/1988 | Larsson | 92/47 |
| 5,021,064 | A | * | 6/1991 | Caines | 623/26 |
| 5,067,390 | A | * | 11/1991 | Negishi | 92/48 |
| 5,134,889 | A | * | 8/1992 | Bradbury | 92/90 |
| 5,506,012 | A | * | 4/1996 | Wright et al. | 428/35.2 |
| 2003/0205045 | A1 | | 11/2003 | Peles | |

FOREIGN PATENT DOCUMENTS

| | | |
|---|---|---|
| DE | 298 160 100 | 11/1998 |
| WO | WO 03/033917 | 4/2003 |

* cited by examiner

*Primary Examiner*—Thomas E Lazo
(74) *Attorney, Agent, or Firm*—Merchant & Gould P.C.

(57) ABSTRACT

A double-acting deformable fluid actuator with three chambers consists of three axisymmetrical coaxial membranes (10, 11 and 12), constrained by two end pieces (13 and 14) so as to identify three chambers, namely, an inner chamber (15), an intermediate chamber (16), and an outer chamber (17); each chamber is supplied with fluid under pressure through respective connectors (18, 19 and 20) set on one of the end pieces.

8 Claims, 2 Drawing Sheets

DOUBLE-ACTING DEFORMABLE FLUID ACTUATOR OF THE MUSCLE TYPE WITH THREE CHAMBERS

The present invention relates to a double-acting deformable fluid actuator with three chambers, capable of exerting both forces of pulling and forces of pushing.

In the context of fluid actuators, recently, alongside the solutions of a traditional type, such as cylinders, there have been developed deformable actuators in which the very structure of the actuator is deformed as a result of the pressure, bringing about a contraction of the actuator itself, and hence application of a pulling force.

Said actuators, which are generically defined as being of a muscular type, present some advantages such as: low mass, high pulling force/mass ratio, absence of sliding parts, high efficiency, absence of any need for lubrication, possibility of working with inexpensive and non-pollutant fluids (non-lubricated air, water), possibility of moving structures that are not kinematically defined, possibility of working in extreme environments (absence of atmosphere, high gradients of surface temperature).

Said characteristics in particular justify the use thereof for the moving of structures in the context of robot, biomechanical and aerospace applications.

On the other hand, muscular actuators present the considerable disadvantage of being able to exert exclusively pulling forces, and hence cannot be used in contexts in which the double-acting embodiment is required, unless two actuators are installed according to the principle of antagonistic muscles.

The actuator built according to the document No. DE-29816100U adds to the advantages of a muscular actuator of a traditional type the possibility of also exerting forces of thrust and can hence be used, not only in systems of automation and moving, and in robot structures, but also in the active isolation of vibrations and in vehicle suspensions.

Said actuator, in one of its embodiments, consists of two coaxial deformable chambers located between two end pieces, namely, an inner chamber and an outer chamber.

The end pieces enable separate supply of the two coaxial chambers, as well as enabling anchorage of the actuator to the structure to be moved.

According to this document, however, the two chambers, i.e., the inner one and the outer one, are separated by a wall of flexible elements with high rigidity, i.e., considerably higher than that of the material with which the membranes that form the chambers are made. Said elements connect the end pieces to one another.

By supplying the outer chamber with a fluid, the flexible elements are deformed, and there is obtained a contraction of the actuator, and by supplying the inner chamber the flexible elements are deformed in the opposite direction, and there is an extension of the actuator.

Also the document No. WO-03/033917, in the name of the present applicant, describes an actuator consisting of two membranes having a deformable coaxial axisymmetrical geometry, which are constrained to two end pieces so as to identify two coaxial chambers: an inner chamber and an outer chamber.

By supplying the outer chamber with fluid under pressure, both of the membranes are deformed circumferentially, but not in a longitudinal direction, so bringing about mutual approach of the end pieces, i.e., exerting a pulling force. Instead, by supplying the outer chamber and the inner chamber simultaneously, the action of the fluid under pressure on the end pieces brings about lengthening of the actuator, i.e., application of a force of thrust.

In the case of this document, unlike the previous document, there are no rigid walls set between the membranes, and the latter have an high deformability in a circumferential direction and a low deformability in the longitudinal direction.

The above characteristic is obtained, for example, by means of the use of elastomeric membranes stiffened longitudinally by means of fibres immersed in the matrix.

This solution, however, presents the drawback of having performance in terms of thrust that is not very high and of not enabling the actuator to operate with forces that are entirely modulatable in each configuration of use.

The purpose of the present invention is to propose a double-acting deformable fluid actuator that will guarantee performance in terms of thrust that are higher than those of actuators of a known type, such as the ones described above.

Another purpose of the invention is to provide an actuator that is able to operate both as actuator with a completely modulatable force in each configuration and as a device for dissipating energy.

For the above and further purposes that will emerge more clearly understandable from what follows, the present applicant proposes to provide a double-acting deformable fluid actuator with three chambers, characterized in that it consists of three axisymmetrical coaxial membranes, constrained by two end pieces, so as to identify three chambers: an inner chamber; an intermediate chamber; and an outer chamber. Each chamber is supplied with fluid under pressure through respective connectors set on one of the pieces.

There will now be described the double-acting deformable fluid actuator according to the invention with reference to the attached plate of drawings, in which.

Figure 1:
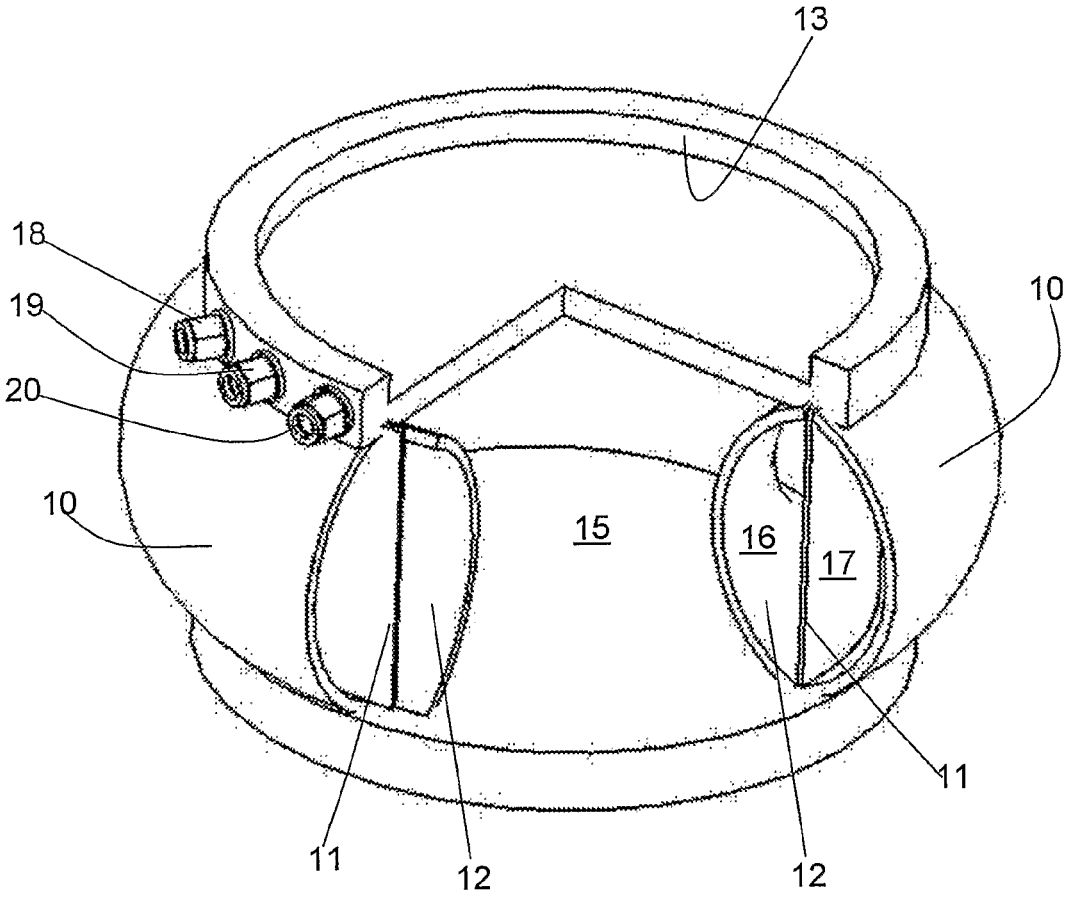
FIG. 1 illustrates the actuator according to the invention, partially sectioned in a first embodiment.

First of all, from FIG. 1 it may be noted that the actuator consists of three axisymmetrical coaxial membranes, 10, 11 and 12, constrained by two end pieces 13 and 14 so as to identify three chambers: an inner chamber 15; an intermediate chamber 16; and an outer chamber 17.

The membranes are amply deformable in one direction, and are practically undeformable in the direction orthogonal to the first.

In particular, the outer membrane 10 and inner membrane 12 have limited or even no extensibility along the meridian line of the actuator, whilst the central membrane 11 is mounted so as to present limited or even no extensibility in a circumferential direction.

The supply of fluid to the three chambers is made through three connectors 18, 19 and 20, set on the top end piece 13, each of the connectors being connected to a respective chamber 15, 16 and 17.

By supplying the intermediate chamber 16 and outer chamber 17 with fluid under pressure, the configuration of pulling is obtained, whilst by supplying the intermediate chamber 16 and the inner chamber 15 with fluid under pressure, the configuration of pushing is obtained.

As compared to known actuators and in particular to the double-acting deformable fluid actuator referred to in the aforesaid document No. WO-03/033917, the present invention enables a better performance in terms of thrust, since the central membrane 11 enables prevention of the effect of pulling of the outer membrane 10.

Furthermore, the presence of three volumes that can in general operate at different pressures enables the device to operate both as actuator with completely modulatable force in each configuration and as a device for dissipation of energy.

Said dissipative function can be obtained during a cycle of operation by means of the interconnection of the chambers of the actuator according to an appropriate scheme that generates an internal flow of fluid through resistances.

Figure 3:
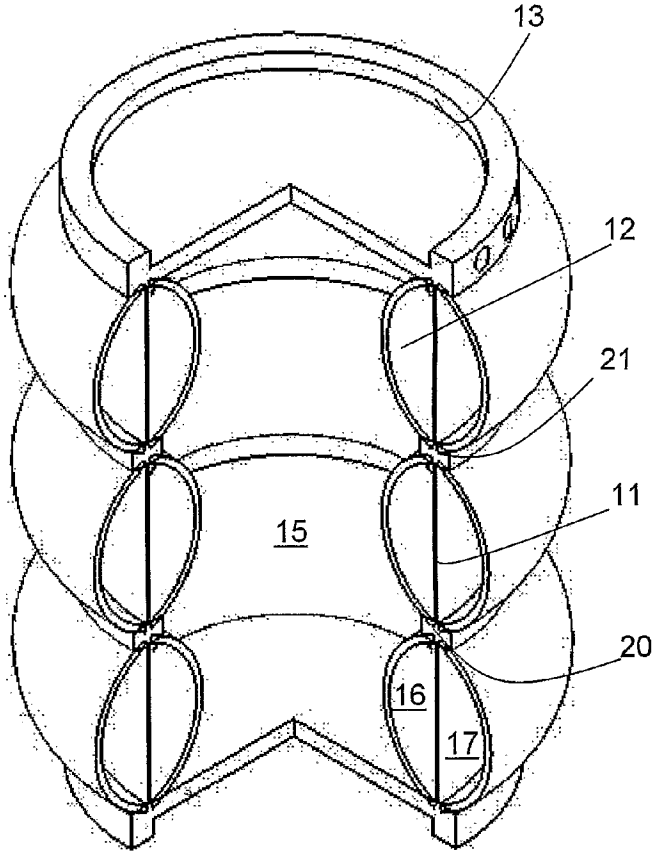
FIGS. 2 and 3 illustrate the actuator according to the invention, once again partially sectioned, in two further embodiments.
Figure 2:
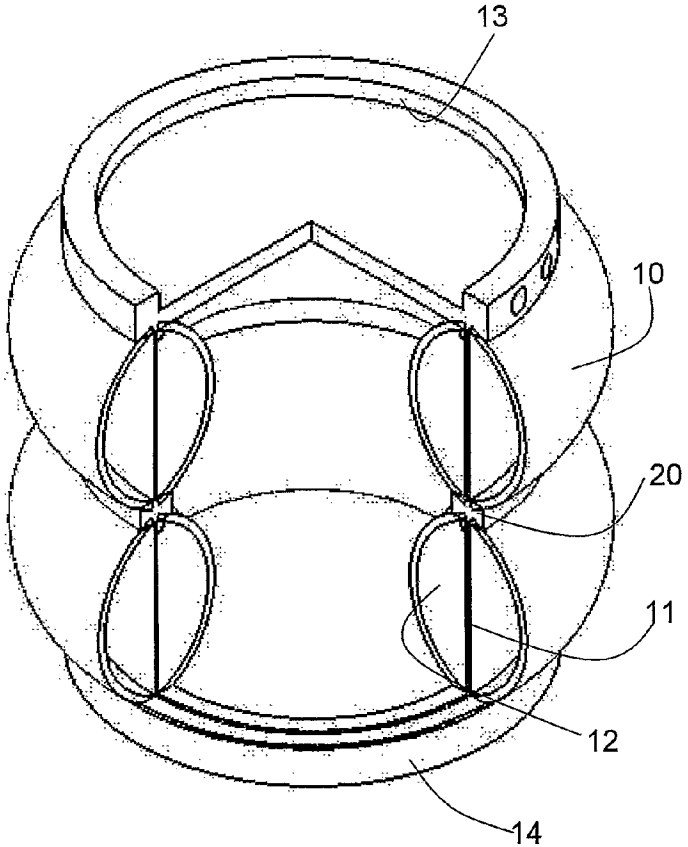

FIGS. 2 and 3 illustrate two variant embodiments of the actuator of FIG. 1, and more precisely in the embodiment of FIG. 2 there are two sets of membranes 10, 11 and 12 of FIG. 1 set on top of one another, in which the two sets are joined by a circumferential connecting stretch 20, which separates the inner chamber 15 from the external environment.

In the embodiment of FIG. 3, the sets of membranes 10, 11 and 12 are three, set on top of one another, separate, and joined by means of two connecting stretches 20 and 21.

Possible variants to the structure of FIG. 1 can envisage a different order in the arrangement of the membranes. In particular, the membrane that is inextensible in a circumferential direction could be the outer one or the inner one, the remaining two being inextensible in the meridian direction. By reversing the order of the membranes, the phases of pushing and pulling are obtained by supplying chambers different from those of the case described previously.

In the case where the membrane that is inextensible in a circumferential direction is the outer one, the thrust is obtained by supplying all three chambers, whereas pulling is obtained by supplying the intermediate chamber; in the case where the membrane that is inextensible in a circumferential direction is the inner one, the thrust is obtained by supplying the inner chamber, and pulling is obtained by supplying the outer chamber.

A further variant embodiment for implementing the same principle of operation envisages having lobed membranes to replace the elongations in a circumferential direction or meridian direction, which are required of the membrane in the hypothesis of operation described previously, with lobed geometrical variations. In particular, the lobes are present in the area in which high deformability is required.

The invention claimed is:

1. A double-acting deformable fluid actuator with three chambers, comprising three axisymmetrical coaxial membranes, constrained by two end pieces, in order to identify three chambers including, an inner chamber, an intermediate chamber, and an outer chamber; each chamber being supplied with fluid under pressure through respective connectors on one of the end pieces.

2. The deformable actuator according to claim 1, wherein the coaxial membranes comprise an outer membrane, a central membrane and an inner membrane, and wherein the outer membrane and the inner membrane have limited extensibility along a meridian direction of an actuator, wherein a central membrane is mounted so as to present limited extensibility in a circumferential direction.

3. The deformable actuator according to claim 1, wherein the coaxial membranes comprise an outer membrane, a central membrane and an inner membrane, and wherein the outer membrane and the inner membrane are inextensible along a meridian direction of a actuator, and wherein the central membrane is mounted so as to be inextensible in a circumferential direction.

4. The deformable actuator according to claim 1, wherein the coaxial membranes comprise an outer membrane, a central membrane and an inner membrane, and wherein the central membrane and the inner membrane have limited extensibility or are inextensible along a meridian direction of an actuator, and wherein the outer membrane is mounted so as to present limited extensibility or to be inextensible in a circumferential direction.

5. The deformable actuator according to claim 1, wherein the coaxial membranes comprise an outer membrane, a central membrane and an inner membrane, and wherein the central membrane and the outer membrane have limited extensibility or are inextensible along a meridian direction of an actuator, and wherein the inner membrane is mounted so as to present limited extensibility or be inextensible in a circumferential direction.

6. The deformable actuator according to claim 1, wherein the membranes present lobes in the areas in which high deformability is required to obtain phases of pushing and pulling.

7. The deformable actuator according to claim 1, wherein the membranes are two, set on top of one another, and joined by a circumferential connecting stretch, which separates an inner chamber from the external environment.

8. The deformable actuator according to claim 1, wherein the sets of membranes are three or more sets, arranged on top of one another, and joined by respective circumferential connecting stretches, which separate an inner chamber from the external environment.

* * * * *